US005810695A

United States Patent [19]

Sass

[11] Patent Number: 5,810,695

[45] Date of Patent: Sep. 22, 1998

[54] WATER TRAMPOLINE DEVICE

[76] Inventor: Randy J. Sass, 5033 N. Tower Beach Rd., Pinconning, Mich. 48650

[21] Appl. No.: 785,778

[22] Filed: Jan. 21, 1997

[51] Int. Cl.[6] ..... A63B 5/11; B63B 35/58

[52] U.S. Cl. ..... 482/27; 441/37

[58] Field of Search ..... 482/27, 23, 28, 482/29; 441/21, 40, 37, 66, 67; 114/125

[56] References Cited

U.S. PATENT DOCUMENTS

| | | | |
|---|---|---|---|
| 1,456,168 | 5/1923 | Witmer | 482/27 X |
| 3,736,607 | 6/1973 | Radnofsky | 441/37 |
| 3,883,913 | 5/1975 | Givens | 441/37 |
| 4,001,905 | 1/1977 | Givens | 441/37 |
| 4,576,375 | 3/1986 | Roberts | 482/27 |
| 4,598,904 | 7/1986 | Roth | 482/27 |
| 4,747,797 | 5/1988 | Hindle | 441/38 |
| 5,385,518 | 1/1995 | Turner | 482/27 |

FOREIGN PATENT DOCUMENTS

| | | | |
|---|---|---|---|
| 473-445-A | 3/1992 | European Pat. Off. | 482/27 |

*Primary Examiner*—Richard J. Apley
*Assistant Examiner*—William LaMarca

[57] ABSTRACT

A water trampoline device including a hollow inflatable frame member that has a textured covering with a plurality of bands interconnected. Included is a baffle chute that is water permeable and has a top edge, a bottom edge and four walls. The top edge is attached to the covering for suspension of the baffle chute from the frame member. A rope is provided and has a stake at one end and a plurality of straps coupled by a connecting ring at another end. Each strap is capable of coupling with the covering of the frame member. Each strap will suspend the rope within the baffle chute for positioning of the stake within the floor of a body of water. The stake is secured to the floor and allows the rope to anchor the frame member. Lastly, a trampoline mat with an outer edge is included. The outer edge has a plurality of springs operatively connected and connected to the bands of the covering for positioning the trampoline mat between the frame member to provided a jumping surface for a user.

3 Claims, 3 Drawing Sheets

WATER TRAMPOLINE DEVICE

BACKGROUND OF THE INVENTION

1. Field of the Invention

The present invention relates to a water trampoline device and more particularly pertains to providing a water toy with a trampoline-like center for use in an open body of water and further including a anchor rope for securing the device to the floor of the body of water.

2. Description of the Prior Art

The use of a water trampoline is known in the prior art. More specifically, water trampolines heretofore devised and utilized for the purpose of water recreation are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,385,518 to Turner discloses a water trampoline. U.S. Pat. No. 4,644,892 to Fisher discloses a boyant trampoline. U.S. Pat. No 4,576,375 to Roberts discloses a flotation trampoline. U.S. Pat. No 4,516,768 to Gallaro discloses an exercise device. U.S. Pat. No. 4,162,063 to Nissen and Kelly discloses adjustable springs for trampolines and the like. Lastly, U.S. Pat. No. 4,139,102 to McNeil discloses a round trampoline with a U-shaped leg.

While these devices fulfill their respective, particular objectives and requirements, the aforementioned patents do not describe water trampoline device that allows the user to bounce, jump and dive form a water toy anchored to the floor of a body of water.

In this respect, the water trampoline device according to the present invention substantially departs from the conventional concepts and designs of the prior art, and in doing so provides an apparatus primarily developed for the purpose of providing a water toy with a trampoline-like center for use in an open body of water and further including a anchor rope for securing the device to the floor of the body of water.

Therefore, it can be appreciated that there exists a continuing need for a new and improved water trampoline device which can be used for providing a water toy with a trampoline-like center for use in an open body of water and further including a anchor rope for securing the device to the floor of the body of water. In this regard, the present invention substantially fulfills this need.

SUMMARY OF THE INVENTION

In view of the foregoing disadvantages inherent in the known types of water trampolines now present in the prior art, the present invention provides an improved water trampoline device. As such, the general purpose of the present invention, which will be described subsequently in greater detail, is to provide a new and improved water trampoline device and method which has all the advantages of the prior art and none of the disadvantages.

To attain this, the present invention essentially comprises a hollow inflatable frame member with a symmetrical configuration. The symmetrical configuration of the frame member allows the formation of an upper periphery, a lower periphery and an inner periphery defining a space therewithin. The frame member has a textured covering that has a plurality of bands interconnected and resting adjacent the upper periphery of the frame member. Also, a generally rectangular baffle chute is provided. The baffle chute is water permeable and has a top edge, a bottom edge and four walls therebetween. The baffle chute has a generally rectangular framework therein and spaced from the bottom edge. The framework is capable of separating the baffle chute into an upper portion and a lower portion with a generally cone shape. The top edge is attached to the covering adjacent the lower periphery of the frame member for suspension of the baffle chute from the frame member. Additionally, an elongated rope is provided. The rope has a stake at one end and a connecting ring at another end. The connecting ring having a plurality of straps coupled thereto. Each strap, when coupled to the connecting ring, is capable of coupling with the covering of the frame member. The plurality of straps, when coupled to the ring and the covering, are capable of suspending the rope from the frame member and within the baffle chute for placement of the stake within the floor of a body of water. The rope is suspended within the baffle chute and the baffle chute is capable of having its bottom edge secured to the stake member. The stake is positioned in the floor and allows the rope to anchor the frame member within the body of water. The baffle chute, when secured to the stake at the bottom edge and secured to the frame member at the top edge, is capable of providing resistance to sidewards movement of the frame member within the body of water. Lastly, an elastic trampoline mat is provided. The mat has an outer edge with a plurality of springs operatively connected. Each spring has an upper hook member and a lower hook member coupled with the outer edge. Each upper hook member is coupled with one of the bands of the covering for positioning the trampoline mat between the space within the inner periphery of the frame member. The trampoline mat is space above the baffle chute and the rope. The trampoline mat is capable of providing a jumping surface for a user between the frame member when the frame member is anchored within the body of water.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water trampoline device which has all of the advantages of the prior art water trampolines and none of the disadvantages.

It is another object of the present invention to provide a new and improved water trampoline device which may be easily and efficiently manufactured and marketed.

It is further object of the present invention to provide a new and improved water trampoline device which is of durable and reliable constructions.

An even further object of the present invention is to provide a new and improved water trampoline device which is susceptible of a low cost of manufacture with regard to both materials and labor, and which accordingly is then susceptible of low prices of sale to the consuming public, thereby making such water trampoline device economically available to the buying public.

Even still another object of the present invention is to provide a water trampoline device for providing a water toy with a trampoline-like center for use in an open body of water and further including a anchor rope for securing the device to the floor of the body of water.

Lastly, it is an object of the present invention to provide a new and improved water trampoline device including a hollow inflatable frame member that has a textured covering with a plurality of bands interconnected. Included is a baffle chute that is water permeable and has a top edge, a bottom edge and four walls. The top edge is attached to the covering for suspension of the baffle chute from the frame member. A rope is provided and has a stake at one end and a plurality of straps coupled by a connecting ring at another end. Each strap is capable of coupling with the covering of the frame member. Each strap will suspend the rope within the baffle chute for positioning of the stake within the floor of a body of water. The stake is secured to the floor and allows the rope to anchor the frame member. Lastly, a trampoline mat with an outer edge is included. The outer edge has a plurality of springs operatively connected and connected to the bands of the covering for positioning the trampoline mat between the frame member to provide a jumping surface for a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
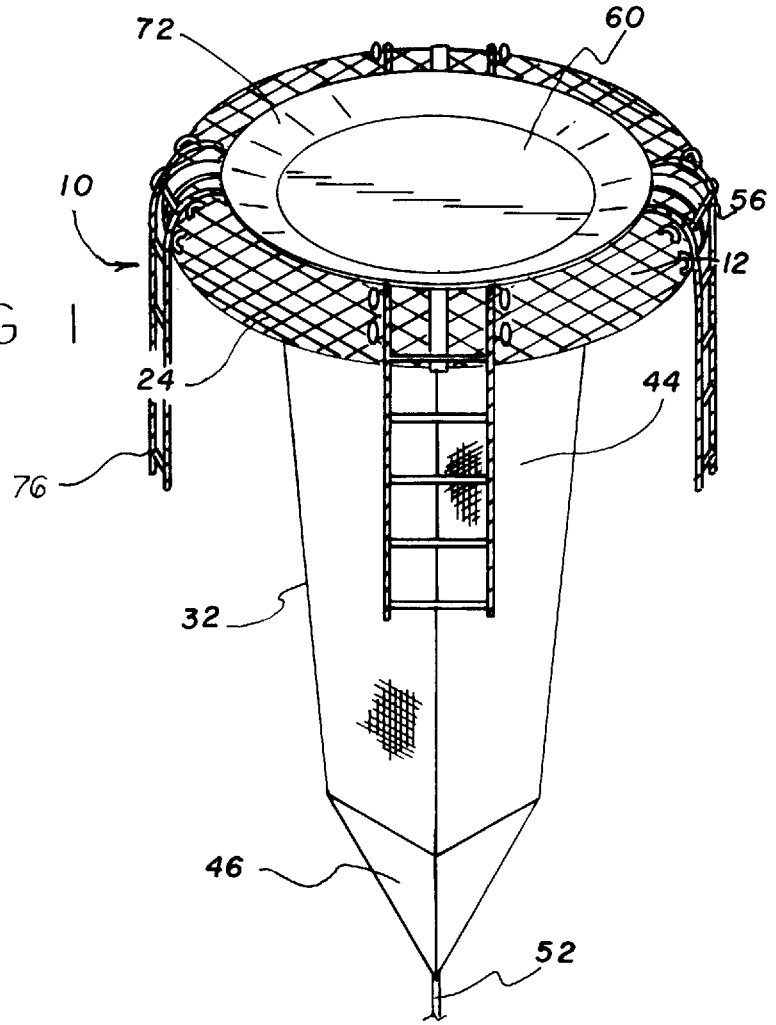
FIG. 1 is a perspective view of the preferred embodiment of the water trampoline device constructed in accordance with the principles of the present invention.

With reference now to the drawings, and in particular to FIG. 1 thereof, the preferred embodiment of the new and improved water trampoline device embodying the principles and concepts of the present invention and generally designated by the reference numeral 10 will be described.

The present invention, the water trampoline device 10 is comprised of a plurality of components. Such components in their broadest context include a frame member, a baffle chute, a rope and a mat. Such components are individually configured and correlated with respect to each other so as to attain the desired objective.

Specifically, the present invention includes a hollow inflatable frame member 12. The frame member, as shown in FIG. 1 has a symmetrical configuration that forms an upper periphery 14, a lower periphery 16 and an inner periphery 18 defining a space 20. The frame member is a non-elastic, collapsible encasement that resembles an inner-tube when fully expanded. The fame member has a textured covering 24 therearound. The covering is a stretchable mesh that surrounds the entire frame member. The covering's structure is easily griped by a swimmer climbing onto the frame member from within the body of water. The covering has a plurality of bands 26 interconnected to an underside 28 of the covering. The bands, as seen in FIG. 5, rest adjacent the upper periphery of the frame member.

Figure 4:
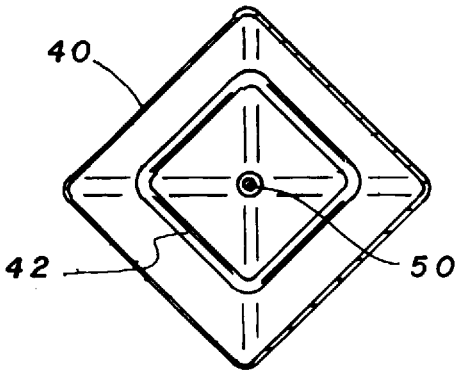
FIG. 4 is a cross-sectional view of the present invention taken along line 4—4 of FIG. 3.

Also, a generally rectangular baffle chute 32 is provided. The baffle chute is water permeable and has a length of about 12 feet. The baffle chute has a top edge 36, a bottom edge 38 and four walls 40. FIG. 4 is a top view that shows the walls of the baffle chute. The baffle chute has a width that decreases from the top edge to the bottom edge. The baffle chute has a generally rectangular framework 42 therein. The framework is flat polyvinylchloride tubing and is spaced from the bottom edge 38. The frame work separates the baffle chute into an upper portion 44 and a lower portion 46. The lower portion forms a generally cone shape as the baffle is stretched by the framework. The lower portion of the baffle, with its width smaller than the upper portion, is capable of holding the framework within the baffle chute.

Figure 5:
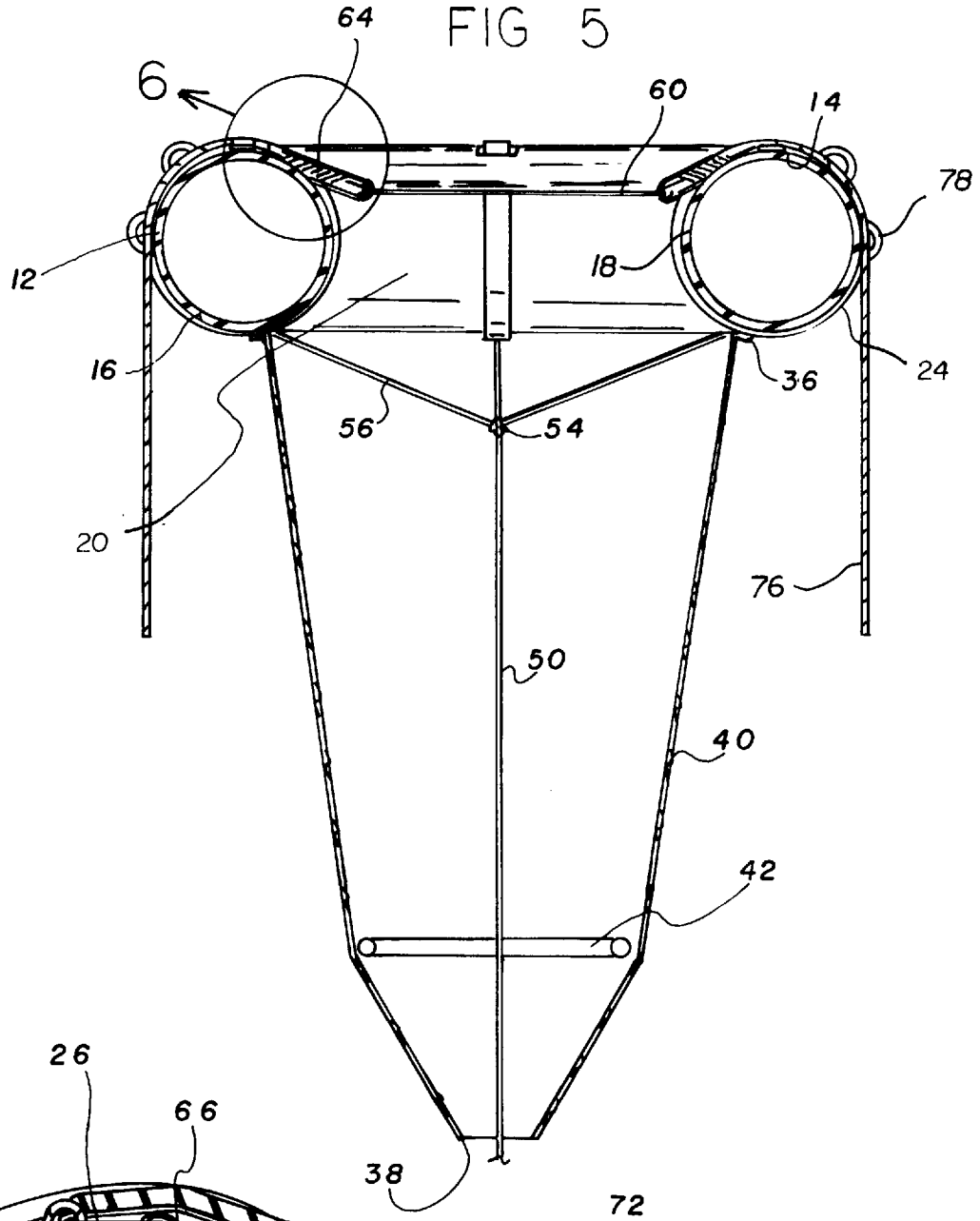
FIG. 5 is a cross-sectional view of the present invention taken along line 5—5 of FIG. 3.

Additionally, as illustrated in FIG. 5, the top edge of the baffle chute is attached to the covering 24 and adjacent the lower periphery of the frame member. Attaching the baffle chute to the covering allows the baffle chute to be suspended from the frame member. When the baffle chute is suspended from the frame member and the frame member is in a body of water, the water passes in and out of the baffle chute in a controlled manner.

Included is an elongated rope 50. The rope has a stake 52 at one end and a connecting ring 54 at another end. The rope is a nylon rope. The connecting ring has a plurality of straps 56 coupled thereto. Each strap when coupled to the connecting ring is coupled with the covering of the frame member. Each strap is looped around the frame member, as seen in FIG. 1. The plurality of straps when coupled to the ring and the covering is capable of suspending the rope from the frame member and within the baffle chute.

Suspending the rope 50 from the frame member allows placement of the stake within the floor of the body of water. The rope, when suspended within the baffle chute, is capable of allowing the bottom edge of the baffle chute 32 to be secured to the stake member. Securing the bottom edge of the baffle chute adds an additional holding force against the framework to hold the framework in position. The stake when positioned in the floor allows the rope to anchor the frame member within the body of water. The baffle chute, when secured to the stake at the bottom edge and secured to the frame member 12 at the top edge 36, is capable of providing resistance to sidewards movement of the frame member within the body of water. Also, the framework the increases resistance to lateral movement of the frame member when anchored within the body of water.

Figure 6:
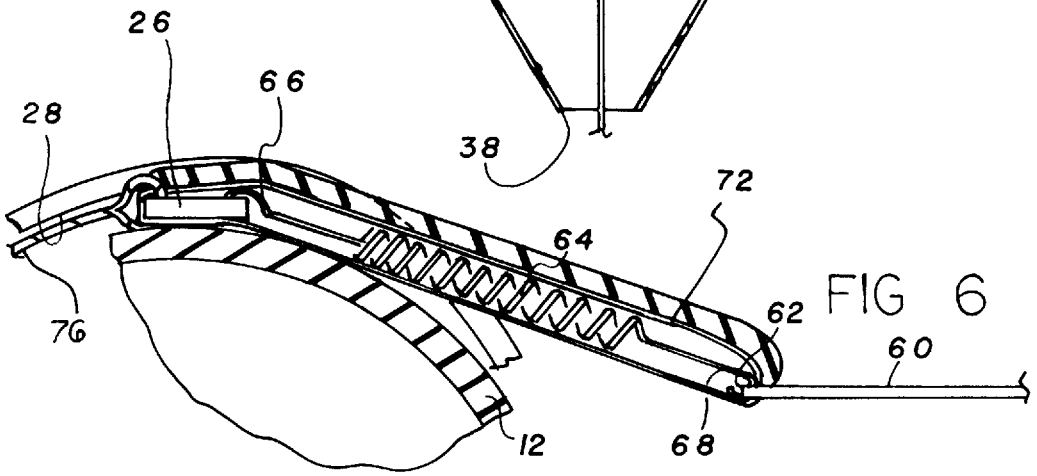
FIG. 6 is an enlarged view of the spring coupling the frame member to the mat member taken at position 6 of FIG. 5.

An elastic trampoline mat 60 is positioned between the frame member as seen in FIG. 1. The trampoline mat has an outer edge 62 with a plurality of springs 64 operatively connected. Each spring has an upper hook member 66 and a lower hook member 68. Each lower hook member is coupled with the outer edge. Each upper hook member is coupled with one of the bands 26 of the covering as seen in FIG. 6. Coupling the upper and lower hook members of the spring allows the positioning of the trampoline mat between the space 20 within the inner periphery of the frame member 12.

Included is an annular cover 72. The annular cover is positioned over the springs and a portion of the upper periphery 14 of the frame of the trampoline mat. The annular cover has a thickness over the frame to protect the user of the water trampoline device from the springs. The annular covers aids in preventing the user from falling between the frame member and the trampoline mat. The trampoline mat is space above the baffle chute and the rope. The trampoline mat provides a jumping surface 74 for a user between the frame member when the frame member is anchored within the body of water. When the user jumps on the jumping surface, the baffle chute and the frame work decrease the swinging motion/ lateral motion of the frame member.

Lastly, a plurality of rope ladders 76 are coupled with the bands 26 of the covering. As seen in FIG. 1, each ladder is proportionately spaced about the frame. Each ladder extends downward from the upper periphery of the frame. The ladders are used to climb onto the water trampoline device.

Figure 2:
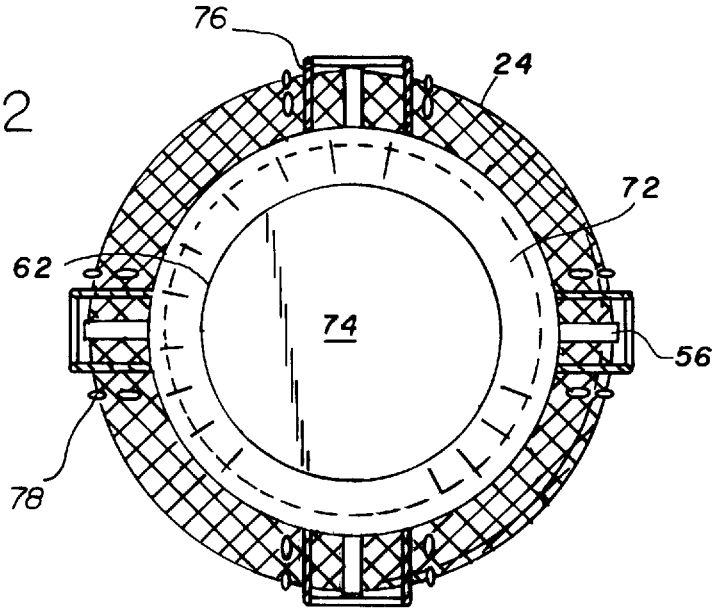
FIG. 2 is a top plan view of the water trampoline device of FIG. 1.
Figure 3:
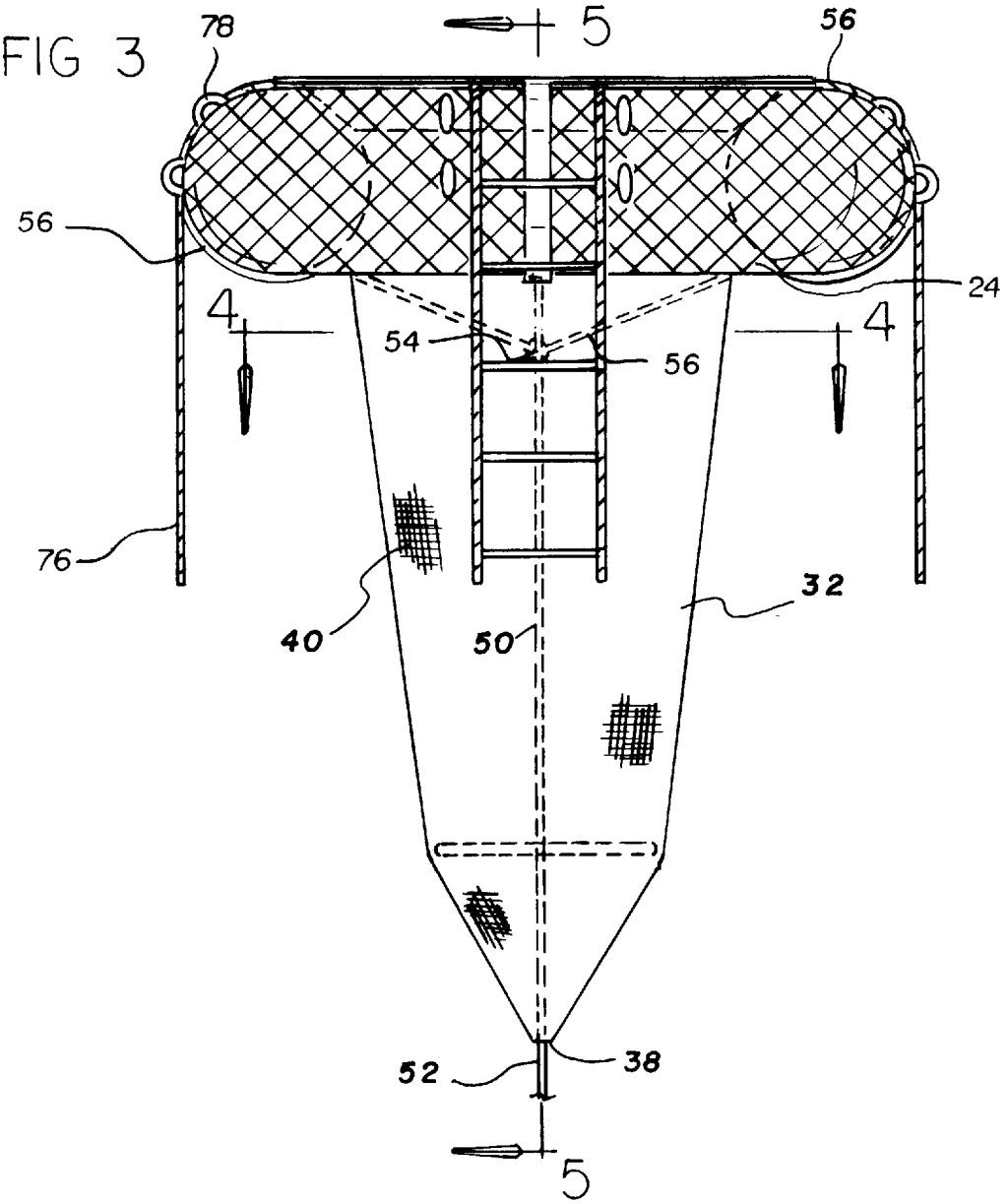
FIG. 3 is a side view of the present invention of FIG. 1.

Furthermore, at least four handles 78 are provided. The four handles are symmetrically spaced adjacent the rope ladder. Each handle is interconnected to the frame member. As shown in FIG. 2, two of the four handles are on each side of the ladder. The handles assist the water trampoline device user with pulling themselves out of the water and onto the device.

The present invention water trampoline device provides an enjoyable water toy for swimming enthusiasts of all ages. The water trampoline device is structured for use in ponds, lakes, rivers and other bodies of water. The frame member 12 inflates for use and deflates for storage and travel. The frame member has a covering that helps the user to easily climb onto the device when it is in the water. The rope, with its stake, anchors the water trampoline device to the floor of the body of water. Anchoring the device prevents it from drifting away with the current.

The baffle chute that is extended for the frame member, will provide resistance to sidewards movement during bouncing. Also, the baffle chute acts as a safety covering for the anchor cord. The baffle chute is in made of a water-permeable material that allows water to flow in between the walls of the baffle chute. A framework is included as an additional enhancement to the baffle chute. The framework is positioned within the baffle chute near the bottom edge. The frame work helps to give the baffle chute definition and prevents is from collapsing under water pressure.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved water trampoline device for use in an open body of water comprising in combination:

a hollow inflatable frame member with a symmetrical configuration, the symmetrical configuration of the frame member allowing for the formation of an upper periphery, a lower periphery and an inner periphery defining a space therewithin, the fame member having a textured covering therearound, the covering having a plurality of bands interconnected and resting adjacent the upper periphery of the frame member;

a generally rectangular baffle chute being water permeable and having a top edge, a bottom edge and four walls therebetween, the baffle chute having a generally rectangular framework therein and spaced from the bottom edge, the framework being capable of separating the baffle chute into an upper portion and a lower portion with a generally cone shape, the top edge being attached to the covering adjacent the lower periphery of the frame member for suspension of the baffle chute from the frame member;

an elongated rope having a stake at one end and a connecting ring at another end, the connecting ring having a plurality of straps coupled thereto, each strap when coupled to the connecting ring being capable of coupling with the covering of the frame member, the plurality of straps when coupled to the ring and the covering being capable of suspending the rope from the frame member and within the baffle chute for placement of the stake within the floor of a body of water, the rope being suspended within the baffle chute capable of having the bottom edge of the baffle chute secured to the stake member, the stake being positioned in the floor allows the rope to anchor the frame member within the body of water, the baffle chute when secured to the stake at the bottom edge and secured to the frame member at the top edge being capable of providing resistance to sidewards movement of the frame member within the body of water; and an elastic trampoline mat having an outer edge with a plurality of springs operatively connected thereto, each spring having an upper hook member and a lower hook member coupled with the outer edge, each upper hook member being coupled with one of the bands of the covering for positioning the trampoline mat between the space within the inner periphery of the frame member, the trampoline mat being space above the baffle chute and the rope, the trampoline mat capable of providing a jumping surface for a user between the frame member when the frame member being anchored within the body of water.

2. A water trampoline device comprising:

a hollow inflatable frame member having a textured covering therearound, the covering having a plurality of bands interconnected and resting adjacent the frame member, the frame member having a symmetrical configuration forming an upper periphery, a lower periphery and an inner periphery defining a space therewithin;

a baffle chute being water permeable and having a top edge, a bottom edge and four walls therebetween, the top edge being attached to the covering for suspension of the baffle chute from the frame member, the baffle chute having a generally rectangular framework therein and spaced form the bottom edge of the baffle chute, the framework being capable of separating the baffle chute into an upper portion and a lower portion with a generally cone shape, and the bottom edge of the baffle chute being coupled to the stake of the rope for retaining the framework within the baffle chute, the bands of the covering being adjacent the upper periphery of the frame member;

a rope having a stake at one end and a plurality of straps coupled by a connecting ring at another end, each strap being capable of coupling with the covering of the frame member for suspending the rope withing the baffle chute for positioning of the stake within the floor of a body of water, the stake being secured to the floor allows the rope to anchor the frame member; and an elastic trampoline mat having an outer edge with a plurality of springs operatively connected thereto and connected to the bands of the covering for positioning the trampoline mat between the frame member to provide a jumping surface for a user, each spring having an upper hook member and a lower hook member coupled with the outer edge of the trampoline mat, each upper hook member being coupled with on of the bands of the covering for positioning the mat in the space within the inner periphery of the frame member.

3. The water trampoline device as set forth in claim 2, wherein the trampoline mat being positioned within the space of the frame member being located above the baffle chute and the rope, and the jumping surface of the trampoline mat capable of being used when the frame member being anchored within the body of water.

* * * * *